US005900102A

United States Patent [19]

Reeves

[11] Patent Number: 5,900,102

[45] Date of Patent: May 4, 1999

[54] METHOD FOR REPAIRING A THERMAL BARRIER COATING

[75] Inventor: Jim D. Reeves, Cincinnati, Ohio

[73] Assignee: General Electric Company, Cincinnati, Ohio

[21] Appl. No.: 08/763,790

[22] Filed: Dec. 11, 1996

[51] Int. Cl.[6] ..... B32B 15/00; C23G 1/02

[52] U.S. Cl. ..... 156/344; 134/3; 134/7; 134/19; 134/21; 134/27; 216/2; 29/402.06

[58] Field of Search ..... 156/344; 29/402.06; 134/3, 7, 19, 21, 27; 216/2

[56] References Cited

U.S. PATENT DOCUMENTS

| | | | |
|---|---|---|---|
| 3,540,878 | 11/1970 | Levine et al. | 75/175.5 |
| 4,004,047 | 1/1977 | Grisik | 427/142 |
| 4,965,095 | 10/1990 | Baldi | 427/142 |
| 5,254,413 | 10/1993 | Maricocchi | 428/633 |
| 5,614,054 | 3/1997 | Reeves et al. | 156/344 |

*Primary Examiner*—James C. Housel
*Assistant Examiner*—Jennifer Graser
*Attorney, Agent, or Firm*—Andrew C. Hess; David L. Narciso

[57] ABSTRACT

A method for repairing a thermal barrier coating on an article designed for use in a hostile thermal environment, such as turbine, combustor and augmentor components of a gas turbine engine. The method is particularly suited for the repair of thermal barrier coatings composed of an aluminide bond coat formed on the surface of an article, and an insulating columnar ceramic layer overlaying the bond coat. Processing steps generally include preparing a powder mixture of a halogen-containing activator and an aluminum-containing material, contacting the ceramic layer with the mixture, and then heating the ceramic layer for a duration sufficient to cause the halogen-containing activator to deteriorate the ceramic layer, while the aluminum-containing constituent of the mixture prevents the bond coat from being attacked or otherwise depleted by the halogen-containing activator. A suitable composition for the mixture is about 0.5 to about 1 weight percent of the halogen-containing activator and about 0.5 to about 1 weight percent of the aluminum-containing material, with the balance being an inert diluent.

20 Claims, No Drawings

METHOD FOR REPAIRING A THERMAL BARRIER COATING

This invention relates to thermal barrier coating systems for components exposed to high temperatures, such as the hostile thermal environment of a gas turbine engine. More particularly, this invention is directed to a method for repairing a thermal barrier coating system formed of an inner bond coat and a thermal-insulating ceramic outer layer, in which the ceramic layer of the coating system is removed without damaging the underlying bond coat.

BACKGROUND OF THE INVENTION

Higher operating temperatures for gas turbine engines are continuously sought in order to increase their efficiency. However, as operating temperatures increase, the high temperature durability of the components of the engine must correspondingly increase. Significant advances in high temperature capabilities have been achieved through the formulation of nickel and cobalt-base superalloys, though such alloys alone are often inadequate to form components located in certain sections of a gas turbine engine, such as the turbine, combustor and augmentor. A common solution is to thermally insulate such components in order to minimize their service temperatures. For this purpose, thermal barrier coating (TBC) systems formed on the exposed surfaces of high temperature components have found wide use.

To be effective, thermal barrier coatings must have low thermal conductivity, strongly adhere to the article, and remain adherent throughout many heating and cooling cycles. The latter requirement is particular demanding due to the different coefficients of thermal expansion between materials having low thermal conductivity and superalloy materials typically used to form turbine engine components. Thermal barrier coatings capable of satisfying the above requirements have generally included a metallic bond coat deposited on the component surface, followed by an adherent ceramic layer that serves to thermally insulate the component. In order to promote the adhesion of the ceramic layer to the component and prevent oxidation of the underlying superalloy, the bond coat is typically formed from an oxidation-resistant alloy such as MCrAlY where M is iron, cobalt and/or nickel, or from an oxidation-resistant intermetallic such as a diffusion aluminide or platinum aluminide. Various ceramic materials have been employed as the ceramic layer, particularly zirconia ($ZrO_2$) stabilized by yttria ($Y_2O_3$), magnesia (MgO) or another oxide. These particular materials are widely employed in the art because they can be readily deposited by plasma spray, flame spray and vapor deposition techniques, and are reflective to infrared radiation so as to minimize the absorption of radiated heat.

A significant challenge of thermal barrier coating systems has been the formation of a more adherent ceramic layer that is less susceptible to spalling when subjected to thermal cycling. For this purpose, the prior art has proposed various coating systems, with considerable emphasis on ceramic layers having enhanced strain tolerance as a result of the presence of porosity, microcracks and segmentation of the ceramic layer. Microcracks generally denote random internal discontinuities within the ceramic layer, while segmentation indicates the presence of microcracks or crystalline boundaries that extend perpendicularly through the thickness of the ceramic layer, thereby imparting a columnar grain structure to the ceramic layer. Ceramic layers for thermal barrier coating systems employed in high temperature applications of a gas turbine engine are typically deposited by electron beam physical vapor deposition (EBPVD) techniques that yield the desirable columnar grain structure, which is able to expand without causing damaging stresses that lead to spallation. A strong adherent continuous oxide surface layer is often formed over the bond coat to protect the bond coat from oxidation and hot corrosion, and to provide a firm foundation for the PVD columnar ceramic layer.

Though significant advances have been made in attaining spallation-resistant thermal barrier coatings, there is the inevitable requirement to repair such coatings under certain circumstances. Typically, spallation occurs in localized regions or patches, either during engine service or during post coating processing of the coated component. In addition to service-related incidents, processing flaws that occur during the formation of the thermal barrier coating system can also necessitate repairs. One example is during the deposition of an EBPVD ceramic layer, where a molten liquid splat of ceramic may mar the coating, rendering the coating unacceptable for service.

The current state-of-the-art repair methods often result in removal of the entire thermal barrier coating system, i.e., both the ceramic layer and bond coat, after which the bond coat and ceramic layer must be redeposited. Due to a heightened resistance to spallation, a columnar ceramic layer is very difficult to remove. Prior art techniques for removing thermal barrier coatings have generally involved grit blasting or subjecting the coating to an alkaline solution at high temperatures and pressures. Grit blasting is a slow, labor-intensive process and erodes the ceramic layer and bond coat, as well as the substrate surface beneath the coating. With repetitive use, the grit blasting process eventually destroys the component. The use of an alkaline solution to remove a thermal barrier coating requires the use of an autoclave operating at high temperatures and pressures, and also results in removal of the entire coating system.

A more recent process for repairing a thermal barrier coating system is disclosed in U.S. patent application Ser. No. 08/362,377 to Reeves et al., assigned to the assignee of this invention. The disclosed process entails heating the thermal barrier coating to about 870° C. or more while exposing the coating to a halogen-containing powder, which causes the coating to deteriorate to the extent that it separates from the underlying substrate. In doing so, both the ceramic layer and the bond coat must be redeposited as a result of the halogen-containing powder attacking each of these layers.

From the above, it can be appreciated that a process for repairing a thermal barrier coating system that does not damage or remove the bond coat would be advantageous. In particular, if a process were available that attacked only the ceramic layer, the labor, processing and costs required to refurbish a thermal barrier coating system could be significantly reduced.

SUMMARY OF THE INVENTION

It is an object of this invention to provide a method for repairing a thermal barrier coating on an article designed for use in a hostile thermal environment, in which the coating is composed of an insulating ceramic layer overlying a metallic bond coat.

It is another object of this invention that such a method entails removal of only the ceramic layer, and therefore does not involve the removal of or damage to the underlying bond coat.

It is yet another object of this invention that the method is particularly well suited for repairing thermal barrier coatings whose ceramic layer has a columnar grain structure and the bond coat is an aluminide alloy.

The present invention generally provides a method of repairing a thermal barrier coating on an article designed for use in a hostile thermal environment, such as turbine, combustor and augmentor components of a gas turbine engine. This method is particularly suited for the repair of thermal barrier coatings composed of an aluminide bond coat formed on the surface of an article, and an insulating columnar ceramic layer overlaying the bond coat. The processing steps of this invention generally include preparing a mixture of a halogen-containing activator and an aluminum-containing material, contacting the ceramic layer with the mixture, and then heating the ceramic layer to a temperature that enables the halogen-containing activator to deteriorate the ceramic layer. According to this invention, during exposure to the mixture, the aluminum-containing constituent of the mixture prevents the bond coat from being attacked or otherwise depleted by the halogen-containing activator.

According to this invention, a suitable composition for the mixture is about 0.5 to about 1 weight percent of the halogen-containing activator, about 0.5 to about 1 weight percent of the aluminum-containing material, such as a titanium, chromium or cobalt aluminide, with the balance being essentially an inert diluent. Furthermore, the process of contacting and heating the ceramic layer can be carried out using a pack diffusion-type process. The process of this invention results in the ceramic layer being essentially completely removed, with essentially no degradation of the bond coat. At most, the bond coat may increase slightly in thickness due to the action of the aluminum-containing material in the mixture. Consequently, a ceramic material can then be deposited on the surface of the same bond coat so as to form a new insulating ceramic layer. As such, the labor, processing and costs required to refurbish a thermal barrier coating system are significantly reduced by the process of this invention.

Other objects and advantages of this invention will be better appreciated from the following detailed description.

DETAILED DESCRIPTION OF THE INVENTION

The present invention is generally applicable to metal components that operate within environments characterized by relatively high temperatures, and are therefore subjected to severe thermal stresses and thermal cycling. Notable examples of such components include the high and low pressure turbine nozzles and blades, shrouds, combustor liners and augmentor hardware of gas turbine engines. While the advantages of this invention are particularly applicable to components of gas turbine engines, the teachings of this invention are generally applicable to any component on which a thermal barrier may be used to thermally insulate the component from its environment.

The method of this invention is particularly suited for the repair of a thermal barrier coating system composed of an aluminide bond coat formed on the surface of the article, and a columnar ceramic layer overlaying the bond coat so as to be adhered to the article. As is the situation with high temperature components of a gas turbine engine, the article may be formed of a nickel-base or cobalt-base superalloy. The bond coat is preferably an oxidation-resistant material so as to be capable of protecting the underlying article from oxidation and to enable the ceramic layer to more tenaciously adhere to the article. A preferred bond coat is an intermetallic nickel or platinum aluminide that is present on the surface of the article at a thickness of about 20 to about 125 micrometers. Preferred methods for depositing bond coats of this type include pack diffusion deposition techniques, though it is foreseeable that other techniques could be used. Following deposition of the bond coat, an oxide layer such as alumina may be formed on the surface of the bond coat by exposure to elevated temperatures. The oxide layer provides a surface to which the columnar ceramic layer can tenaciously adhere, thereby promoting the resistance of the coating system to thermal shock.

To attain a strain-tolerant columnar grain structure, the ceramic layer is preferably deposited by physical vapor deposition using techniques known in the art, e.g., EBPVD. A preferred material for the ceramic layer is an yttria-stabilized zirconia (YSZ), a preferred composition being about 6 to about 8 weight percent yttria, though other ceramic materials could be used, including yttria, nonstabilized zirconia, or zirconia stabilized by ceria ($CeO_2$) or scandia ($Sc_2O_3$). The ceramic layer is deposited to a thickness that is sufficient to provide the required thermal protection for the article, generally on the order of about 75 to about 300 micrometers.

Components of a gas turbine engine are subjected to hot combustion gases during operation of the engine, and are therefore subjected to severe attack by oxidation, corrosion and erosion. Accordingly, such components must remain protected from the hostile environment of the turbine section by the thermal barrier coating system, and loss of the ceramic layer will lead to premature and often rapid deterioration of the component. Furthermore, a flawed ceramic layer will tend to rapidly deteriorate under the severe operating environment of a gas turbine engine component, resulting in premature spallation. Accordingly, coated components having spalled or flawed coating systems are repaired on a routine basis.

The repair method of this invention entails exposing the ceramic layer of a thermal barrier coating system to a novel powder mixture within a specific elevated temperature range. In order to suitably attack the ceramic layer while leaving the bond coat intact, the powder mixture contains a halogen-containing activator, an aluminum-containing material, and an inert diluent. The activator is the agent that attacks the ceramic layer to the extent that the ceramic layer is displaced or can otherwise be readily removed from the component. A suitable activator is ammonium fluoride, though other known halogen activators could be used, such as chlorides, bromides, iodides and other fluorides, including NaF, KF and $NH_4Cl$.

The aluminum-containing material is critical to the process of this invention, in that it serves as a neutralizing agent to prevent the depletion of the bond coat while the ceramic layer is being attacked by the halogen-containing activator. To be suitable for use with this invention, the aluminum-containing material must have a melting temperature that is higher than the elevated temperature to which the powder mixture is heated to remove the ceramic layer. Suitable materials include powders of titanium, chromium and/or cobalt aluminides, with a preferred aluminide being a titanium aluminide powder, such as a ternary Ti—Al—C alloy disclosed in U.S. Pat. No. 3,540,878 to Levine et al. This alloy contains, in weight percent, 50–70% Ti, 20–48% Al, and 0.5–9% C, and includes a dispersion of $Ti_2AlC$ complex carbide in a matrix of titanium, aluminum or their alloys.

Finally, a suitable inert diluent is an aluminum oxide (alumina) powder, though it is foreseeable that other inert compositions could be used. The diluent serves to sufficiently dilute the other constituents to yield a controllable reaction, and further serves to prevent sintering of the aluminum-containing particles at the elevated process temperatures.

The powder mixture of this invention preferably contains about 0.5 to about 1 weight percent of the halogen-containing activator, and about 0.5 to about 1 weight percent of the aluminide alloy, with the balance being essentially the inert diluent. A particularly preferred composition for the powder mixture is about 0.5 weight percent ammonium fluoride, and about 0.75 weight percent of the Ti—Al—C alloy powder, with the balance being aluminum oxide powder. While the constituents employed by this invention have been used in combination for prior art pack diffusion coating processes, such processes were for the limited purpose of depositing an aluminide coating on a nickel or cobalt-base superalloy article. In addition, such processes necessitate the use of an aluminide alloy at much higher levels than that permitted by this invention. According to this invention, the ability of low levels of an aluminum-containing material to protect an aluminide bond coat in the presence of a halide activator was neither known nor expected.

A preferred method for exposing the ceramic layer to the above-described powder mixture of this invention is to place the coated component article in the powder mixture such that the ceramic layer directly contacts the powder mixture. The component and powder are then heated to a temperature of about 925° C. to about 980° C., preferably about 950° C., for a duration sufficient to enable the activator to deteriorate and remove the ceramic layer without depleting the bond coat. In practice, a suitable duration for this process is about two to about four hours. While the process of this invention could foreseeably be carried out with a variety of equipment, a preferred apparatus is basically that used for pack diffusion coating processes of the prior art, in that the method of this invention is a pack diffusion-type process.

According to this invention, the above-described process does not attack or deplete the bond coat. At most, the thickness of the bond coat may slightly increase, typically not more than about five micrometers. Notably, the temperature at which the process is performed is sufficient to enable the activator to attack the ceramic coating, yet sufficiently low to avoid excessive growth of the bond coat via deposition of the aluminum-containing component of the powder mixture. Once the ceramic layer has been removed, the bond coat can be prepared for deposition of a new ceramic layer by undergoing light grit blasting and/or chemical cleaning. Finally, a ceramic material is then deposited on the surface of the bond coat so as to form a new insulating ceramic layer that completely covers the bond coat. A preferred deposition method is a physical vapor deposition technique, such as EBPVD, though a plasma spray technique could be used under certain circumstances.

During the evaluation of this invention, specimens of a nickel-base superalloy provided with a thermal barrier coating system were treated in accordance with the above process. The coating systems had an outer EBPVD ceramic layer of yttria-stabilized zirconia characterized by a columnar grain structure, and an underlying diffusion platinum aluminide bond coat. The thickness of the ceramic layer was about 125 micrometers, while the bond coats had an average thickness of about 70 micrometers. Various powder mixture compositions and test conditions were evaluated in accordance with Table I below. The activator was ammonium fluoride ($NH_4F$), while the aluminum-containing material was the Ti—Al—C alloy of Levine et al. Levels of the activator and aluminum-containing constituents of the powder mixture are indicated below in weight percent, while the balance of the powder mixture was aluminum oxide powder.

TABLE I

| SPECIMEN | $NH_4F$ | Ti-Al-C | T (° C.) | t (hrs.) |
|---|---|---|---|---|
| A | 1.0 | 1.0 | 950 | 4 |
| B | 0.5 | 0.5 | 925 | 2 |
| C | 0.75 | 0.75 | 925 | 3 |
| D | 1.0 | 1.0 | 925 | 4 |
| E | 0.75 | 1.0 | 950 | 2 |
| F | 1.0 | 0.5 | 950 | 3 |
| G | 0.5 | 0.75 | 950 | 4 |
| H | 1.0 | 0.75 | 980 | 2 |
| I | 0.5 | 1.0 | 980 | 3 |
| J | 0.75 | 0.5 | 980 | 4 |

With each of the specimens, the ceramic layer was attacked while the bond coat remained substantially intact. The ceramic layers of all specimens were notably attacked to a degree sufficient to facilitate their removal, though the treatments most effective at removing the ceramic layers were A, E, F and G. The bond coats of the specimens exhibited an increase in their thickness on the order of about zero to about five micrometers, with an average increase being about two micrometers.

Based on the above results, the treatment temperature was determined to be critical relative to the reactant concentrations in the powder mixtures evaluated. Relatively low reactant concentrations were found to be required to avoid frontal attack of the bond coat by the activator and to avoid growth of the bond coat by the aluminum-containing material. Based on these restrictions, a sufficiently high temperature was found to be necessary to attack and break the ceramic-to-metallic interface bond, while avoiding excessive temperatures that would cause the bond coat to diffuse. Based on these considerations, optimal conditions for the process of this invention were concluded to be a treatment temperature of about 950° C. (about 1750° F.) and a powder mixture containing about 0.5 weight percent activator and about 0.75 weight percent aluminum-containing material, with a preferred process duration of about three hours.

From these results, it is apparent that the present invention provides a significantly improved process for repairing thermal barrier coatings. Most notably, the method eliminates the prior practice of removing the entire original thermal barrier coating, and instead enables the removal of only the ceramic layer, thereby leaving the bond coat intact for subsequent deposition of a new ceramic layer. As such, the labor, cost and time to repair a thermal barrier coated component is greatly reduced, with little or no adverse effect on the thermal cycle fatigue life of the repaired coating.

While our invention has been described in terms of a preferred embodiment, it is apparent that other forms could be adopted by one skilled in the art. Accordingly, the scope of our invention is to be limited only by the following claims.

What is claimed is:

1. A method for removing a ceramic layer overlying a metallic bond coat, the method comprising the steps of, preparing a mixture comprising a halogen-containing activator and an aluminum-containing metallic material; and contacting the ceramic layer with the mixture and heating the ceramic layer to a temperature of at least about 950° C. for a duration sufficient to enable the halogen-containing activator to deteriorate the ceramic layer without damaging the bond coat.

2. A method as recited in claim 1 wherein the ceramic layer was originally deposited on the bond coat by a physical vapor deposition technique.

3. A method as recited in claim 1 wherein the mixture comprises about 0.5 to about 1 weight percent of the halogen-containing activator, about 0.5 to about 1 weight percent of the aluminum-containing metallic material, with the balance being essentially an inert diluent.

4. A method as recited in claim 1 wherein the contacting step is a pack diffusion process.

5. A method as recited in claim 1 wherein the aluminum-containing metallic material is an aluminide.

6. A method as recited in claim 1 wherein the duration of the contacting step is about two to about four hours and the temperature of the contacting step is about 925° C. to about 980° C.

7. A method as recited in claim 1 wherein the bond coat is a diffusion aluminide bond coat.

8. A method as recited in claim 1 wherein, as a result of the contacting step, the bond coat exhibits a change in thickness of not more than about five micrometers.

9. A method as recited in claim 1 wherein the ceramic layer and the bond coat constitute a thermal barrier coating system.

10. A method for removing a ceramic layer overlying a metallic bond coat, the method comprising the steps of:

providing an article having a thermal barrier coating system comprising a ceramic layer and an aluminide bond coat;

preparing a powder mixture comprising a halogen-containing activator, an aluminum-containing metallic material and an inert diluent;

placing the article in the powder mixture such that the ceramic layer contacts the powder mixture; and heating the article and powder mixture to a temperature of about 925° C. to about 980° C. for a duration sufficient to enable the halogen-containing activator to deteriorate and remove the ceramic layer without depleting the bond coat.

11. A method as recited in claim 10 wherein the ceramic layer was originally deposited on the bond coat by a physical vapor deposition technique.

12. A method as recited in claim 10 wherein the mixture comprises about 0.5 to about 1 weight percent of the halogen-containing activator, about 0.5 to about 1 weight percent of the aluminum-containing metallic material, with the balance being essentially an inert diluent.

13. A method as recited in claim 10 wherein the contacting step is a pack diffusion process.

14. A method as recited in claim 10 wherein the aluminum-containing metallic material is an aluminide.

15. A method as recited in claim 10 wherein the aluminum-containing metallic material is a ternary Ti—Al—C alloy.

16. A method as recited in claim 10 wherein the duration of the contacting step is about two to about four hours.

17. A method as recited in claim 10 wherein the bond coat is an alloy chosen from the group consisting essentially of nickel aluminide and platinum aluminide alloys.

18. A method as recited in claim 10 wherein, as a result of the contacting step, the bond coat exhibits an increase in thickness of about 0 to about 5 micrometers.

19. A method as recited in claim 10 wherein the article is a component of a gas turbine engine.

20. A method for repairing a thermal barrier coating system, the method comprising the steps of:

providing an article having a thermal barrier coating system comprising a ceramic layer and an aluminide bond coat;

preparing a powder mixture consisting essentially of about 0.5 weight percent of a halogen-containing activator and about 0.75 weight percent of a ternary Ti—Al—C alloy, with the balance being an inert diluent;

placing the article in the powder mixture such that the ceramic layer contacts the powder mixture; and heating the article and powder mixture to a temperature of about 925° C. to about 980° C. for a duration sufficient to enable the halogen-containing activator to deteriorate and remove the ceramic layer without depleting the aluminide bond coat and without increasing the thickness of the aluminide bond coat by more than about five micrometers.

* * * * *